US007765960B2

(12) United States Patent
Rozendaal

(10) Patent No.: US 7,765,960 B2
(45) Date of Patent: Aug. 3, 2010

(54) DEVICE FOR CLEANING THE FIRE TUBES IN A BOILER

(75) Inventor: Niels Alexander Rozendaal, Zevenaar (NL)

(73) Assignee: SIF Ventures B.V., Zevenaar (NL)

( * ) Notice: Subject to any disclaimer, the term of this patent is extended or adjusted under 35 U.S.C. 154(b) by 573 days.

(21) Appl. No.: 10/561,534

(22) PCT Filed: Jun. 18, 2004

(86) PCT No.: PCT/NL2004/000436

§ 371 (c)(1),
(2), (4) Date: Mar. 29, 2007

(87) PCT Pub. No.: WO2004/113818

PCT Pub. Date: Dec. 29, 2004

(65) Prior Publication Data

US 2007/0204812 A1 Sep. 6, 2007

(30) Foreign Application Priority Data

Jun. 20, 2003 (NL) ..... 1023715

(51) Int. Cl.
*F22B 9/00* (2006.01)
*F22B 37/48* (2006.01)

(52) U.S. Cl. ..... 122/379; 122/44.1

(58) Field of Classification Search ..... 122/44.1, 122/75, 53, 54, 58 FB, 379, 405; 134/6; 165/84, 95; 126/387.1
See application file for complete search history.

(56) References Cited

U.S. PATENT DOCUMENTS 4,367,790 A 1/1983 Draeger
4,382,465 A * 5/1983 Baron et al. ..... 165/95
4,422,210 A * 12/1983 Bergsand et al. ..... 15/302
4,478,207 A * 10/1984 Walker et al. ..... 126/101
4,562,886 A * 1/1986 Holm ..... 165/94
4,676,301 A 6/1987 Sakamoto
4,724,007 A * 2/1988 Barry et al. ..... 134/1
5,348,234 A * 9/1994 van der Woude ..... 239/753
5,437,248 A * 8/1995 Miura et al. ..... 122/51
5,558,046 A * 9/1996 Schoppe et al. ..... 122/367.1
5,566,649 A * 10/1996 Norris ..... 122/379
6,536,379 B1 * 3/2003 Liu ..... 122/379
6,565,756 B2 * 5/2003 Piesslinger-Schweiger . 210/724

(Continued)

FOREIGN PATENT DOCUMENTS

DE 82 928 10/1895

(Continued)

*Primary Examiner*—Gregory A Wilson
(74) *Attorney, Agent, or Firm*—The Webb Law Firm

(57) ABSTRACT

A device for use when cleaning the heating surface of a tube changer, such as the fire tubes in a boiler, having a scraper member that is fixed to a movement member for moving the scraper member through one fire tube at a time and a guide for positioning the scraper member directly in front of the open end of a fire tube, such that said scraper member can be moved from the guide into the fire tube and conversely from the fire tube into the guide. The guide can be moved on a frame transversely with respect to the longitudinal direction of the fire tubes for automatic cleaning of the fire tubes both when in service and out of service.

27 Claims, 6 Drawing Sheets

U.S. PATENT DOCUMENTS 7,005,012 B2 * 2/2006 Bourrelly et al. ..... 134/8

FOREIGN PATENT DOCUMENTS

| | | |
|---|---|---|
| EP | 0 967 452 | 12/1999 |
| FR | 352 807 | 8/1905 |
| GB | 253816 | 6/1926 |
| GB | 1027717 | 4/1966 |
| JP | 2000180093 | 6/2000 |

* cited by examiner

DEVICE FOR CLEANING THE FIRE TUBES IN A BOILER

BACKGROUND OF THE INVENTION (1) Field of the Invention

The invention relates to, in combination, a device for cleaning fire tubes in a boiler, comprising a scraper member that is fixed to a movement member for moving said scraper member through one fire tube at a time, a guide for positioning the scraper member directly in front of the open end of a fire tube such that this is movable from the guide into the fire tube and conversely from the fire tube into the guide, as well as a boiler provided with fire tubes, which fire tubes open at one end of the boiler, wherein the guide is movable transversely with respect to the longitudinal direction of the fire tubes on a frame that is located at the end of the boiler where the fire tubes open, and wherein a flue box is located at the end of the boiler where the fire tubes open, which flue box has openings that are each located opposite a fire tube.

(2) Description of the Related Art

A device for cleaning fire tubes is disclosed in GB-A 253 816. In this known device the guide can be fitted opposite a fire tube by means of a screw connector such that the scraper member, such as a wire brush, can then be moved to and fro through said fire tube to remove contaminants. After the fire tube has been cleaned in this way, the guide is removed and then screwed in at the location of the following fire tube to be cleaned. The cycle is repeated in this way until all fire tubes to be cleaned have been treated. What is important is that, if unhealthy working conditions have to be avoided, this device can be used only when the boiler is not in service.

Such a state of affairs is laborious and labour-intensive, which is associated with high costs. Moreover, such activities are dirty and unattractive; a further disadvantage is that according to ARBO (Health and Safety at Work) legislation the boiler has to be taken out of service before carrying out the work.

EP-A 967 452 discloses a combination of a cleaning device and a boiler, where the guide can be moved on a frame transversely to the longitudinal direction of the fire tubes. As a result the fire tubes of the boiler can be cleaned more efficiently.

Because the guide is mounted on a frame, this has a stable support and it is no longer necessary to screw in the guide at the location of each fire tube. Treatment of the boiler can consequently be automated. However, the frame for moving the guide extends into the flue chamber. A high temperature prevails in the flue chamber and the flue gases give rise to an aggressive environment. As a result the movement system can develop a fault and the life will be shortened.

Furthermore, the movement member for moving the brush is constituted by a flexible drive element that is guided in a sleeve in the form of a hose. This movement member can reach each fire tube from a single inlet in the flue box, that is to say the movement member traverses a different curved path for each fire tube. As a result, wear will rapidly occur in the hot and dirty flue box, so that this flexible drive element is relatively unreliable.

Furthermore, pushing the drive element though a fire tube that is not located in the centre will lead to kinking, in particular for boilers with a diameter of 2-5 meters or more. As soon as kinking occurs, the force that is needed to push the brush through the fire tube can no longer be exerted.

The aim of the invention is to provide a combination of a cleaning device and a boiler that enables automatic treatment of the boiler, wherein the reliability is increased.

Said aim is achieved according to the invention in that there is a flue box at the end of the boiler where the fire tubes open, which flue box has openings that are each located opposite a fire tube and are each provided with a closing valve and the device is provided with an operating mechanism that can be brought into interaction with one of the closing valves in each case for opening said closing valve.

By using closing valves for openings in the rear plate of the flue box it is possible to position the frame completely outside the flue box. As a result, the hot and aggressive conditions in the flue box will not have an adverse effect on the functioning of the frame and the movement of the scraper member. The reliability is improved by this means. In addition, the interaction between the closing valve and the operating mechanism ensures that cleaning of the fire tubes can be automated.

SUMMARY OF THE INVENTION

According to the invention the tube can be movable in the longitudinal direction between a retracted position outside the flue box and a projecting position in the flue box, wherein the openings in the flue box are each aligned with an associated fire tube and wherein the tube, in the projecting position, forms an essentially straight guide for the scraper member between the opening and associated fire tube. The flexible movement member, such as a cable, is accommodated in the tube. The scraper brush can be withdrawn from the tube or pushed through the tube by coiling up or unwinding the cable. Pushing the cable through the entire length of the fire tube, for example 6 meters, is effective because the cable is pushed through the tube in a straight line. If the cable has to go round a bend, the risk of the cable jamming is appreciable. In this case it is preferable that drive means are provided for driving the movement member though the tube, wherein the position where the drive means engage on the movement member is essentially on the axis of the opening and associated fire tube.

In one embodiment according to the invention, the scraper member comprises a brush that has at least one open segment in cross-section. Removal of the fouling from the fire tube usually takes place in countercurrent to the flue gases. A closed brush that moves in the opposite direction to the flue gases would have to push a plug of contaminants through the fire tube in front of the brush. This can lead to an undesirable increase in the resistance and ultimately jamming of the brush. However, as a result of the open segment in the brush the flue gases can carry along the fouling loosened from the inside of the fire tube past the brush. What is achieved by this means is that the brush is less likely to jam in the fire tube.

It is possible that there is a contaminant discharge at the end of the fire tube that opens into the flue box. Because there is sufficient room between the tube and the outlet of the fire tube, the contamination that has been loosened can reach the flue box. It is not necessary to transport the contaminants outside the rear plate of the flue box. This would give rise to unhealthy working conditions.

The contaminant discharge can be implemented in several ways. For example, the contaminant discharge has a clearance that is kept free between the guide when the latter is in the projecting position and the end of the fire tube that opens into the flue box. The tube can also have a smaller diameter than the fire tube to make an annular clearance between them or the guide can have holes at the end facing the fire tube for discharging contaminants into the flue box.

In particular the guide can be vertically movable and horizontally movable on the frame. Preferably, the guide is mounted on a boom, which boom is mounted on the frame such that it can be moved in the vertical and horizontal direction. The guide can comprise a tube; in this case the movement member is preferably a cable that is sufficiently rigid to push the scraper member through the tube.

Furthermore, the guide can be mounted on the boom such that it can be moved in the longitudinal direction. The scraper member can then be brought directly in front of the opening of the fire tube to be cleaned for the purposes of transferring the scraper member. The cable is fixed at one end to the scraper member, and can be fixed at the other end to a winding member, such as a roller, drum or spiral tube and the like. In this case the entire set-up is of fairly limited dimensions and consequently can easily be brought opposite each desired fire tube. For this purpose the winding member is preferably likewise supported on the boom.

The device according to the invention is in particular suitable for use with a boiler having a flue box or return box into the end of which the tubes open, which flue box has an opening provided with a closing valve opposite each tube, wherein an operating mechanism is provided at the free end of the boom, which operating mechanism can be brought into interaction with a closing valve for opening and closing said closing valve.

To ensure a good seal between the inserted tube and the flue box, the tube can be provided with a gland on the outside, some distance away from its insertion end, to provide a seal between the opening and the tube inserted therein.

The invention furthermore relates to a device for use when cleaning the heating surface of a tube changer, such as the fire tubes in a boiler, comprising a scraper member that is fixed to a movement member for moving said scraper member through one fire tube at a time, a guide for positioning the scraper member directly in front of the open end of a fire tube, such that said scraper member is movable from the guide into the fire tube and conversely from the fire tube into the guide, wherein the guide can be moved on a frame transversely with respect to the longitudinal direction of the fire tubes, wherein the device is suitable for use with a boiler having a flue box, into the end of which the fire tubes open, which flue box has an opening provided with a closing valve opposite each fire tube.

According to the invention the device comprises an operating mechanism that can be brought into interaction with a closing valve for opening and closing said closing valve.

At the end of the boiler, where the fire tubes open, there is a flue box that has openings that are each located opposite one fire tube. According to the invention provision is made that each opening has a closing valve and that the device has an operating mechanism that can be brought into interaction with one of the closing valves in each case, for opening said closing valve.

The closing valves can be implemented in various ways. In particular, they can each be connected by means of a bayonet fitting to the flue box or a pipe section fixed thereto, the operating mechanism then comprising a movable arm that can engage on the closing valve to turn it.

In addition, the closing valves can each be connected by means of a hinge to the flue box or a pipe section fixed thereto, the operating mechanism then comprising a movable arm for turning the closing valve about the hinge.

According to one embodiment the closing valve has a valve body and a lever that are on either side of the hinge. The arm has a ram that can be moved in the longitudinal direction to make the lever and the closure body tip as a result of contact with the free end of the ram. The closing valve can be held pressed in the closed position under the influence of gravity and/or under the influence of spring force.

The guide can comprise a tube that can move in the longitudinal direction thereof and is provided on the outside, some distance away from its insertion end, with a gland to provide a seal between the opening and the tube inserted therein.

BRIEF DESCRIPTION OF THE DRAWINGS

The invention will be explained in more detail below with reference to an illustrative embodiment shown in the figures.

DETAILED DESCRIPTION OF THE INVENTION

Figure 1:
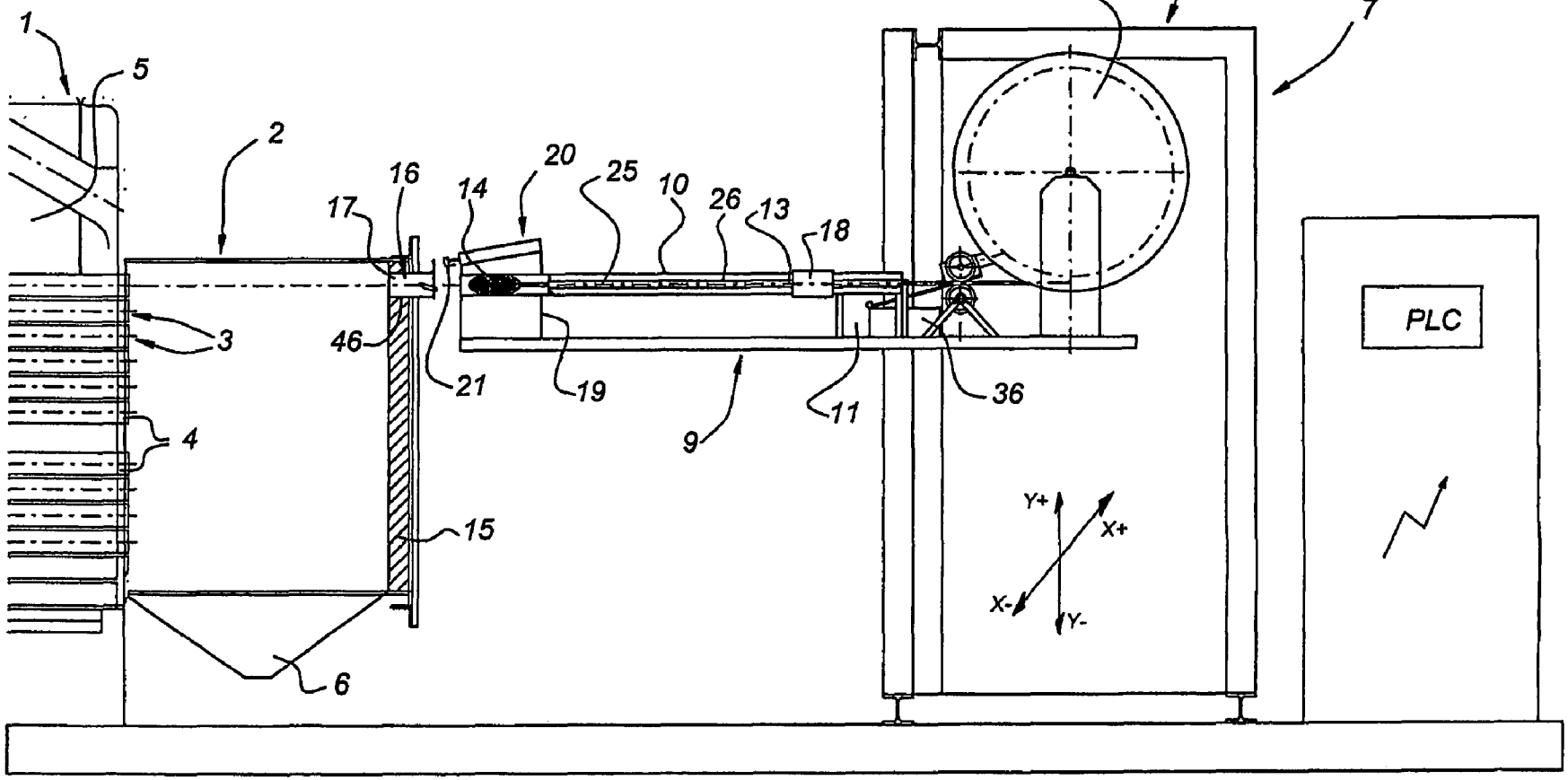
FIG. 1 shows a sectional side view of part of a boiler with a device according to the invention in a first stage of the cleaning process.
Figure 2:
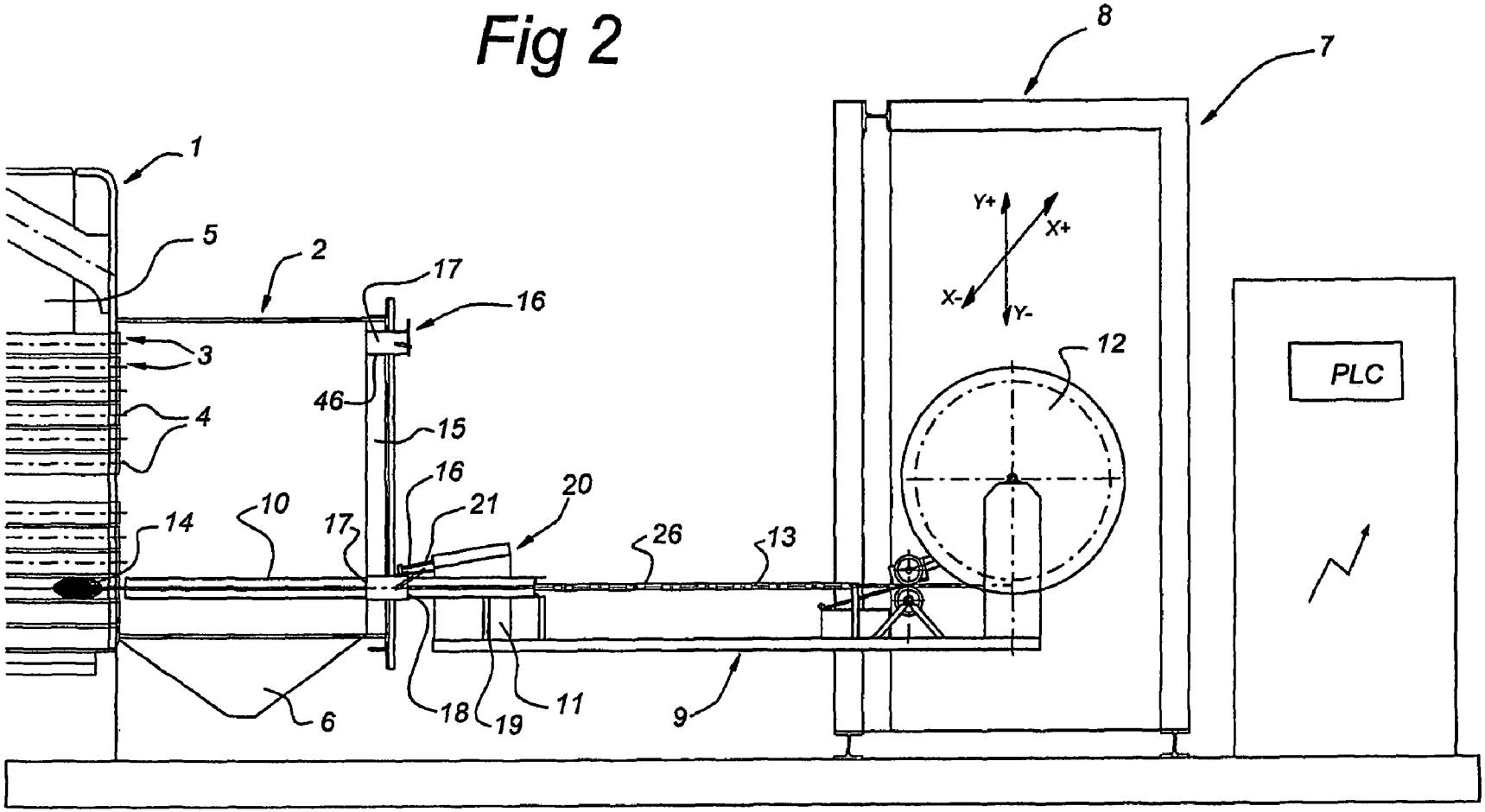
FIG. 2 shows a corresponding side view in a second stage.

The end of a boiler 1 where the flue box 2 is located is shown in FIGS. 1 and 2. In the customary manner, the boiler 1 has a large number of fire tubes 3, the end 4 of which, which is shown, opens into the flue box 2. At the other end, which is not shown, there is a burner that produces the hot flue gases that flow through the fire tubes 3. The water that is in the boiler 1 outside the fire tubes 3 in the chamber 5 is heated by means of these hot flue gases.

The flue gases that have flowed through the fire tubes 3 collect in the flue box 2. The flue box 2 is delimited at the bottom by collection means 6, in which the waste that originates from the combustion process and that deposits on the inside of the fire tubes 3 is able to collect. This fouling is highly dependent on the fuel used in the burner. The combustion of gases produces relatively little fouling; solid fuels, on the other hand, produce substantial deposition of contaminants in the fire tubes.

For the purposes of cleaning the fire tubes 3, the device indicated in its entirety by 7 is positioned next to the flue box 2. This device 7 has a frame 8 on which a boom 9 is mounted such that it can be moved up and down and also back and forth. A tube 10 is mounted on the boom, which tube 10 can be slid by means of the longitudinal guide 11 in its longitudinal direction with respect to the boom 9, and specifically between the retracted position as shown in FIG. 1 and the projecting position as shown in FIG. 2.

A reel 12 is also mounted on the boom 9, at the end thereof that faces away from the boiler 1. A cable 13 is taken upon this reel the scraper brush 14 being fixed to the free end of said cable 13. This scraper brush 14 has a diameter such that it fits in the tube 10 with the ability to slide. The front and rear of the scraper brush 14 are conical or pointed with the aim of facilitating and guiding the insertion thereof into a tube. By coiling up or unwinding the cable 13, the scraper brush can be retracted into the tube 10 or projected from the tube 10 for cleaning the fire tubes 3. The procedure for this is as follows.

Figure 4:
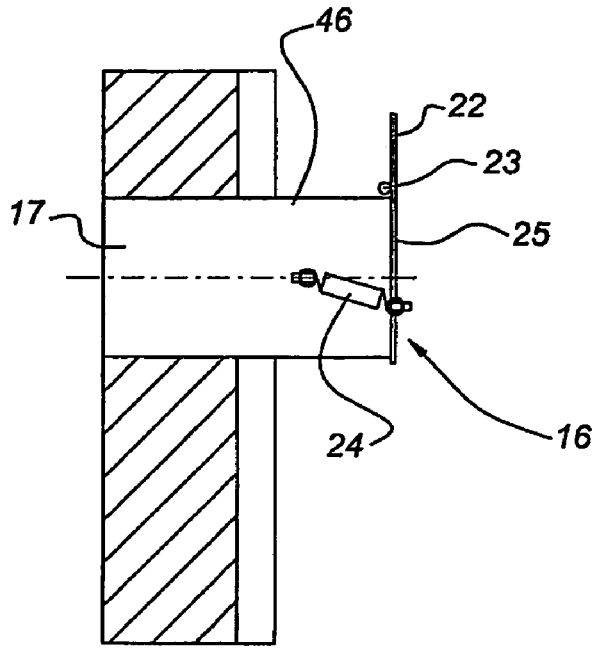
FIG. 4 shows a detail of a valve on a larger scale, in side view and in section.
Figure 5:
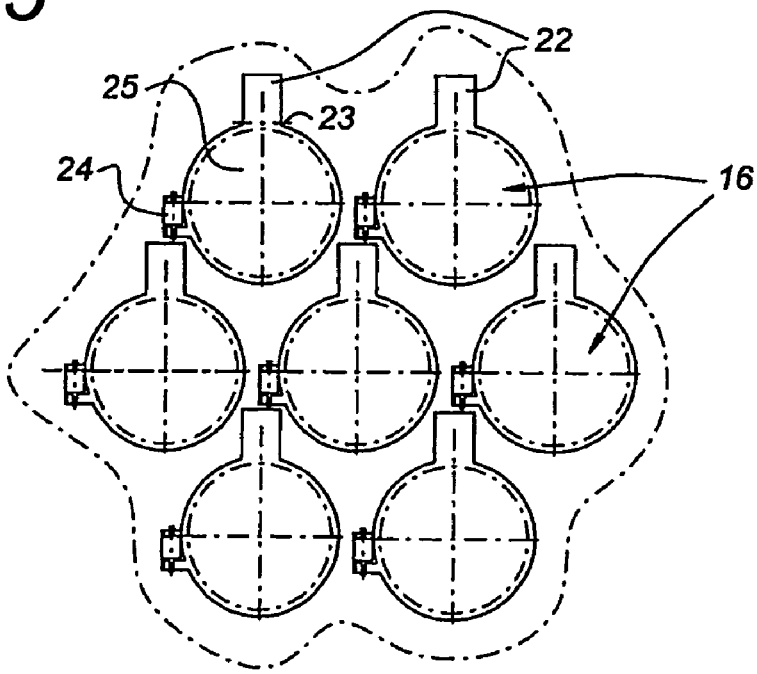
FIG. 5 shows a front view of a number of valves.

First of all, with the tube 10 in the retracted position as shown in FIG. 1, the scraper brush 14 is brought outside the flue box 2 opposite the fire tube 3 that has to be cleaned. The wall 15 of the flue box facing the device 7 has a number of openings 17, defined by the pipe sections 46, each of which is aligned with an associated fire tube 3 and which are closed off by a valve 16, as is also shown in FIGS. 4 and 5. The valve 16 is then opened in a manner to be described in more detail, such that the tube 10 with the scraper brush 14 can be brought via the flue box 2 directly in front of the opening 4 of the fire tube 3 to be cleaned. In this context the tube 10 has a gland 18 that is positioned such that when the brush is just in front of the relevant opening 4 of the fire tube 3, the opening 17 in the wall 15 of the flue box 2 is closed off by said gland 18.

The scraper brush can then be pushed from the tube 10 into the fire tube 3 concerned. Depending on the cleaning procedure used, the scraper brush 14 will be moved to and fro in the fire tube 3 during this operation. Finally, the contaminants that have been loosened are carried away with the flue gases or are collected in the collection means 6 when the scraper brush 14 is withdrawn from the fire tube 3. Finally, the tube 10 with the scraper brush retracted therein is removed from the flue box 2 and the valve 16 is closed.

Driving of the tube 10 and of the scraper brush 14 is effected by means of the cable 13. Because the scraper brush 14 fits in the tube 10 with some friction, the tube 10 is initially pushed out. As soon as this has reached its maximum projecting position against the stop 19, the scraper brush 14 is then pushed out of the tube 10. The cable 13 is sufficiently rigid to exert the requisite forces even under pressure. Moreover, it is stabilised in the guide tube 26, which is firmly connected to the boom 9 by means of support 36, and in the fire tube 3, so that there is no risk of kinking. The advantage of such a cable wound on the reel 12 is that the long fire tubes 3 can be treated in their entirety without long rods and the like being needed for this; the device 7 can consequently have limited dimensions.

Opening and closing of the valve 16 shown in FIGS. 1, 2, 4 and 5 takes place in the following way. At the free end of the boom 9 there is an operating mechanism 20 that has a ram 21 that can be moved forwards and backwards. The valve 16, in turn, has a lever 22 that is on the opposite side of the hinge 23 to the valve body 25. The valve is continuously held pressed in the closed position by means of a spring 24. By now moving the ram 21 forwards, this pushes the lever 22 aside, as a result of which the valve 16 tips and the valve body exposes the opening 17. The scraper brush 14 can then be inserted into the fire tube 3 as described above. After the cleaning work has been carried out in the fire tube 3 concerned, the scraper brush 14 is retracted into the tube 10, after which the valve 16 closes under the influence of the spring 24.

Figure 6A:
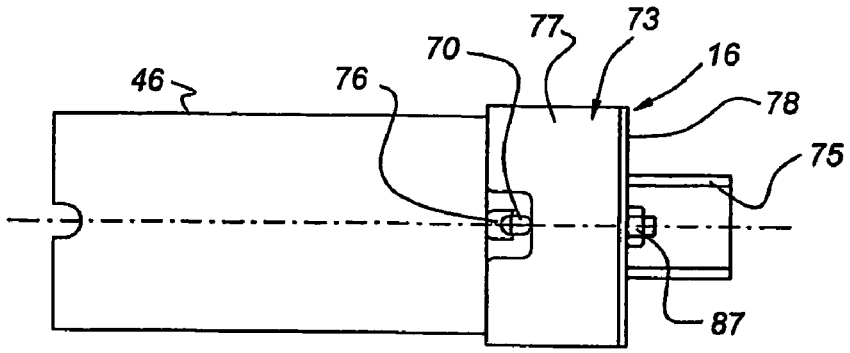
FIGS. 6*a*-6*c* show, respectively a side view and a cross-sectional view of a closing valve with bayonet fitting, as well as a front view of a number of such valves.
Figure 6B:
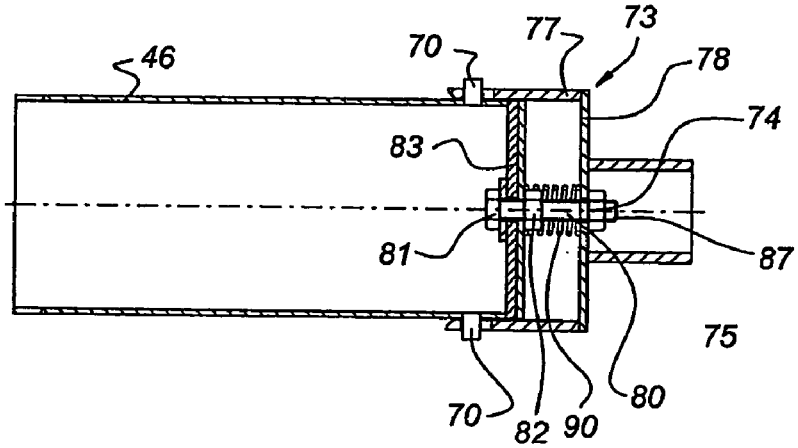
Figure 6C:
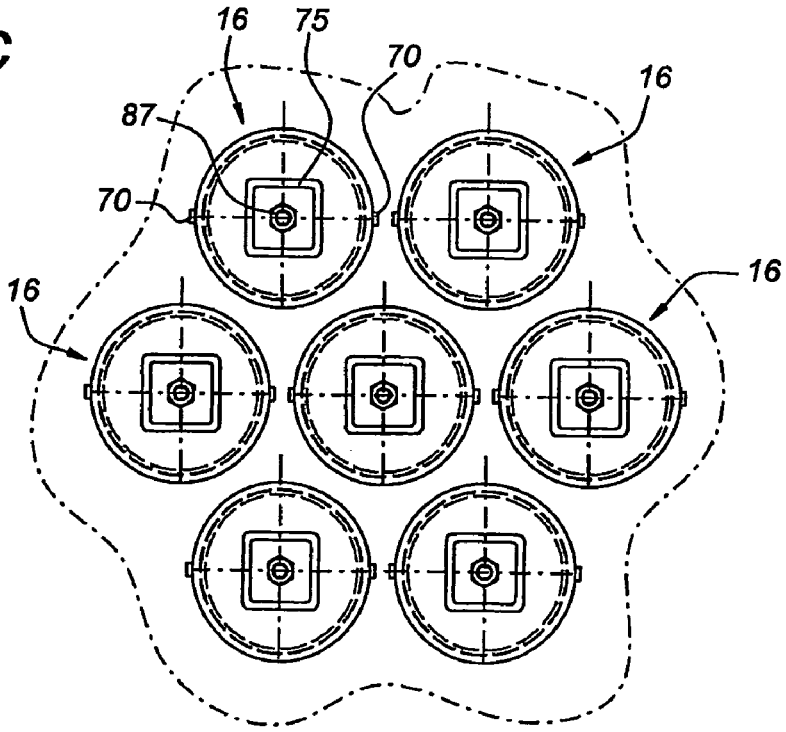

An alternative embodiment of the closing valve 16 is shown in FIG. 6*a*-6*c*. This embodiment of the closing valve has a bayonet fitting.

FIG. 6*a* shows a side view of a pipe section 46. Such pipe sections 46 constitute the openings 17 in the rear wall 15 of the flue box 2. The pipe section 46 is provided with stubs 70. In this illustrative embodiment two stubs 70 are located diametrically opposite one another (see FIG. 6*c*).

The closing valve 16 has a sleeve 73, having a peripheral wall 77, which is closed off at one end by a rear wall 78. A central opening 74 is provided in the rear wall 78. The sleeve 73 has a protruding part 75 with a shape such that an operating mechanism can clamp the protruding part 75 firmly and turn the closing valve 16. In this case the protruding part 75 is constituted by a tube section having a square cross-section that surrounds the central opening 74. The sleeve 73 furthermore has two hook members 76 on the peripheral wall 77 thereof, which hook members 76 are able to interact with the stubs 70.

The closing valve 16 furthermore has a bolt 80, the shank of which can be slid through the central opening 74. A nut 82 clamps a closure plate 83 against the head 81 of the bolt 80. Preferably, there is a washer between the nut 82 and the closure plate 83 and between the head 81 and the closure plate 83. Furthermore, a pretensioned spring 90 is mounted onto the shank of the bolt 80 between the closure plate 83 and the rear wall 78 of the sleeve 73. The spring 90 pushes the closure plate 83 against the peripheral rim of the pipe section 46. The opening in the pipe section 46 is then sealed. A self-locking nut 87 at the end of the bolt 80 facing away from the head 81 prevents the shank of the bolt 80 shooting out of the central opening 74.

The mode of operation of the valve 16 is as follows. In the closed position the hook members 76 of the valve 16 hook behind the respective stubs 70, whilst the closure plate 83 closes off the pipe section 46 under the influence of the spring pretension. To open the valve 16 a suitable operating mechanism (not shown) pushes on the valve 16, the rear wall 78 of the sleeve 73 moving towards the closure plate 83. The hook members 76 can now be turned so they are no longer behind the stubs 70. After tuning the valve, for example through an angle of 10-20°, the operating mechanism pulls the valve off the pipe section 46. It is then possible to guide the tube 10 though the pipe section 46. The reverse procedure is used for closing the valve.

Figure 3:
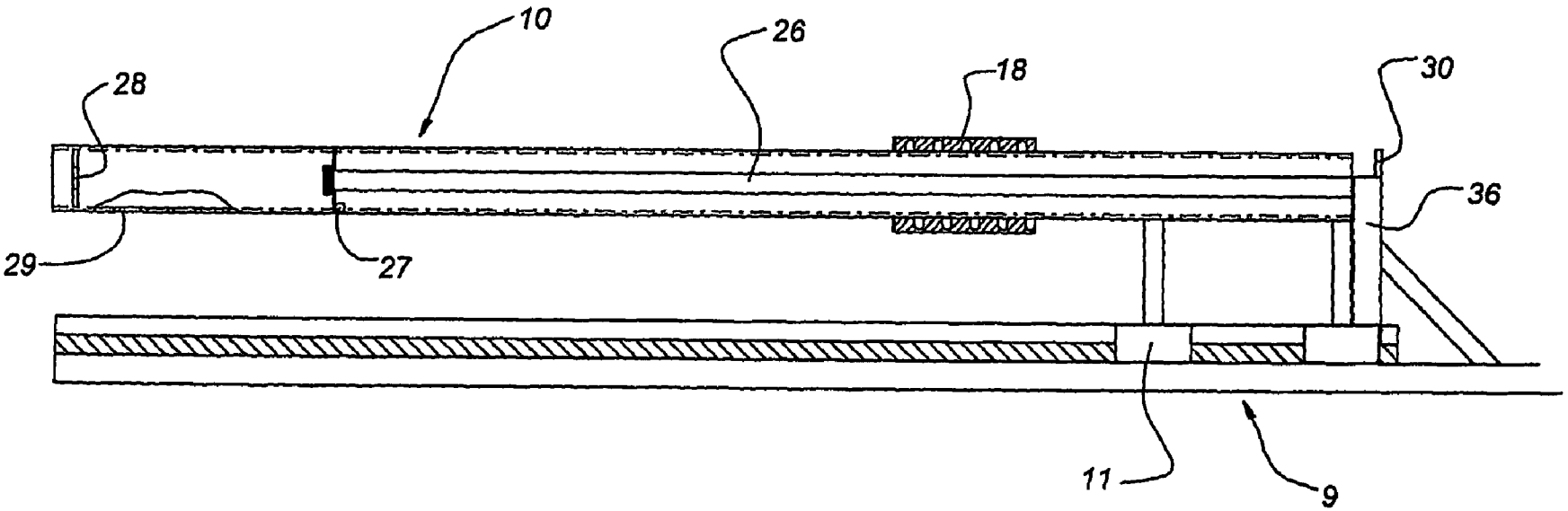
FIG. 3 shows a detail of the guide on a larger scale.

As is most clearly shown in FIG. 3, the tube 10 fits around the guide tube 26 in a telescopic manner. To guide this telescopic movement, a roller 27 is mounted at the end of the guide tube 26, which roller 27 rolls along the inside of the tube 10. At the end of the tube 10 there is also a ring 28 that extends inwards over some distance. This ring 28 forces the hairs of the brush to bend to some extent when the scraper brush 14 is moved past it, such that the scraper brush 14 is cleaned. Holes 29 in the bottom wall of the tube 10 at the location of the ring 28 ensure that the dirt released during this operation is discharged.

Figure 7A:
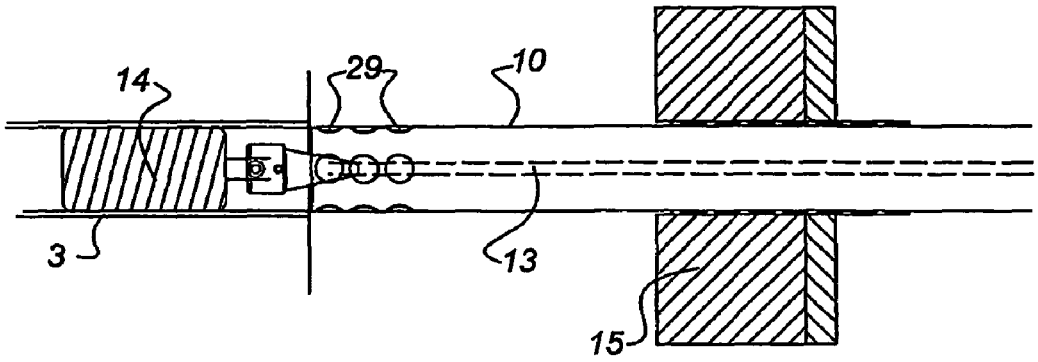
FIGS. 7*a*-7*c* show cross-sectional views of embodiments of the guide and a fire tube.
Figure 7B:
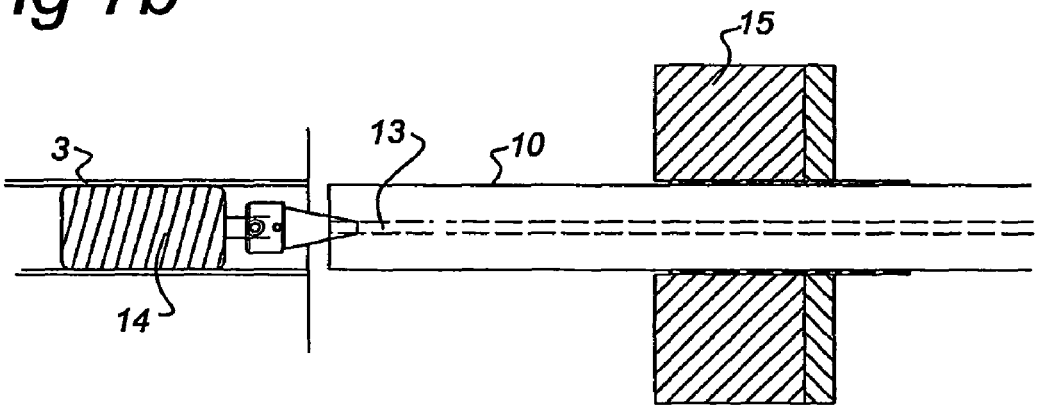
Figure 7C:
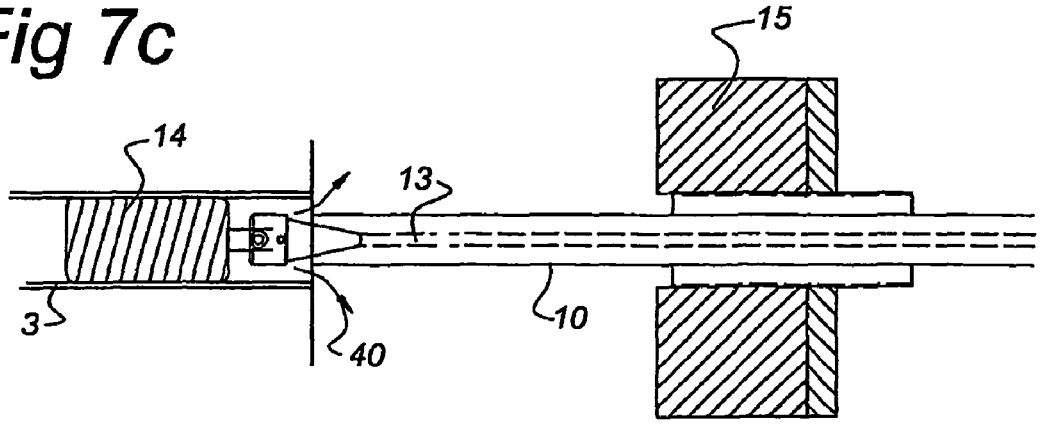

Discharge of contaminants close to the end of the fire tube that opens into the flue box is an important aspect of the invention that is of independent significance. This discharge can be implemented in various ways. In addition to making holes 29, as shown in FIG. 3 and FIG. 7*a*, it is, for example, possible to maintain a gap between the end of the tube 10 and the end of the fire tube 3 (see FIG. 7*b*). The diameter of the tube 10 can also be made smaller than the diameter of the fire tube 3, as shown in FIG. 7*c*. In this case an annular clearance 40 is made. A combination of two or more of these embodiments or yet other embodiments is, of course, possible. This aspect of the invention therefore relates to, in combination, a device for cleaning fire tubes in a boiler, comprising a scraper member that is fixed to a movement member for moving said scraper member through one fire tube at a time, a guide for positioning the scraper member directly in front of the open end of a fire tube, such that this is movable from the guide into the fire tube and conversely from the fire tube into the guide, as well as a boiler provided with fire tubes, which fire tubes open at one end of the boiler, characterised in that a contaminant discharge is arranged close to the end of the fire tube that opens into the flue box.

Closing valves 16 that can hinge are shown in FIGS. 4 and 5, whilst closing valves 16 that are connected by means of a bayonet fitting to the flue box 2 or a pipe section 46 fixed thereto are shown in FIGS. 6*a*-*c*. If, for whatever reason, there is no room for such closing valves, valves of a different type can also be used. These can be, for example, stoppers or plugs, which are gripped by suitable gripper means on the tube 10 and are pushed axially into the openings 4.

As shown in FIG. 3, a compressed air supply is connected to the guide tube 26. By supplying this compressed air, which exits at the other end of the guide tube 26, a blast of air can be introduced into the fire tube to be cleaned before the scraper brush 14 is inserted. The compressed air can also act as barrier air to prevent flue gases escaping in the case of excess pressure.

The invention claimed is:

1. In combination, a device for cleaning fire tubes in a boiler, comprising a scraper member that is fixed to a movement member for moving said scraper member through one fire tube at a time, a guide for positioning the scraper member directly in front of the open end of a fire tube such that this is movable from the guide into the fire tube and conversely from the fire tube into the guide, a boiler provided with fire tubes, which fire tubes open at one end of the boiler, wherein the guide is movable transversely with respect to the longitudinal direction of the fire tubes on a frame that is located at the end of the boiler where the fire tubes open, and wherein a flue box is located at the end of the boiler where the fire tubes open, which flue box has openings that are each located opposite a fire tube, wherein said openings are each provided with a closing valve and the device is provided with an operating mechanism that can be brought into interaction with one of the closing valves in each case for opening said closing valve.

2. The combination according to claim 1, wherein the guide is mounted on a boom, which boom is mounted on the frame such that it is movable in the vertical and horizontal direction, and wherein the operating mechanism is at the free end of the boom.

3. The combination according to claim 1, wherein the guide comprises a tube.

4. The combination according to claim 3, wherein the tube is movable in the longitudinal direction between a retracted position outside the flue box and a projecting position in the flue box, wherein the openings in the flue box are each aligned with an associated fire tube, and wherein the tube, in the projecting position, forms an essentially straight guide for the scraper member between the opening and associated fire tube.

5. The combination according to claim 4, wherein drive means are provided for driving the movement member through the tube, wherein the position where the drive means engage on the movement member is essentially on the axis of the opening and associated fire tube.

6. The combination according to claim 1, wherein the movement member is flexible, such as a cable.

7. The combination according to claim 1, wherein the scraper member comprises a brush that has at least one open segment in cross-section.

8. The combination according to claim 7, wherein the open segment or several open segments together leave between a quarter and half of the circular cross-section of the fire tube free.

9. The combination according to claim 8, wherein the open segment or several open segments together leave one-third of the circular cross-section of the fire tube free.

10. The combination according to claim 1, wherein there is a contaminant discharge at the end of the fire tube that opens into the flue box.

11. The combination according to claim 10, wherein the contaminant discharge has a clearance that is kept free between the guide when the latter is in the projecting position and the end of the fire tube that opens into the flue box.

12. The combination according to claim 10, wherein the tube has a smaller diameter than the fire tube to make an annular clearance between them.

13. The combination according to claim 10, wherein the guide has holes at the end facing the fire tube for discharging contaminants into the flue box.

14. The combination according to claim 1, wherein the guide is movable vertically on the frame.

15. The combination according to claim 1, wherein guide is movable horizontally on the frame.

16. The combination according to claim 1, wherein the tube is mounted on the boom such that it is movable in the longitudinal direction, and a guide tube is provided that is fixed to the boom, which tube is mounted in a telescopic manner around the guide tube and in which guide tube the cable is accommodated.

17. The combination according to claim 16, wherein a compressed air supply is connected to the guide tube.

18. The combination according to claim 1, wherein the cable is fixed at one end to the scraper member and at the other end to a winding member such as a roller or drum and the like.

19. The combination according to claim 1, wherein the winding member is supported on the boom.

20. The combination according to claim 1, wherein the closing valves are each connected by means of a hinge to the flue box and the operating mechanism comprises a movable arm for turning the closing valve about the hinge.

21. The combination according to claim 20, wherein the closing valve has a valve body as well as a lever that are on either side of the hinge, and the arm has a ram that is movable in the longitudinal direction to make the lever and valve body tip as a result of contact with the free end of the ram.

22. The combination according to claim 1, wherein the closing valve is held pressed in the closed position under the influence of gravity.

23. The combination according to claim 1, wherein the closing valve is held pressed in the closed position under the influence of spring force.

24. The combination according to claim 1, wherein the closing valves are each connected by means of a bayonet fitting to the flue box, and the operating mechanism comprises a movable arm for pushing in and turning the closing valve.

25. The combination according to claim 1, wherein the guide comprises a tube that is movable in the longitudinal direction thereof and that is provided on the outside, some distance away from its insertion end, with a gland to provide a seal between the opening and the tube inserted therein.

26. The combination according to claim 1, wherein the closing valves are each connected by means of a pipe section and the operating mechanism comprises a movable arm for turning the closing valve.

27. The combination according to claim 1, wherein the closing valves are each connected by means of a bayonet fitting to a pipe section fixed thereto, and the operating mechanism comprises a movable arm for pushing in and turning the closing valve.

* * * * *